US008144108B2

(12) United States Patent
Kim

(10) Patent No.: US 8,144,108 B2
(45) Date of Patent: Mar. 27, 2012

(54) LIQUID CRYSTAL DISPLAY DEVICE AND DRIVING METHOD THEREOF

(75) Inventor: Ki Duk Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 735 days.

(21) Appl. No.: 12/003,749

(22) Filed: Dec. 31, 2007

(65) Prior Publication Data

US 2009/0015601 A1 Jan. 15, 2009

(30) Foreign Application Priority Data

Jul. 13, 2007 (KR) ..... 10-2007-0070610

(51) Int. Cl.
*G09G 3/36* (2006.01)

(52) U.S. Cl. ..... 345/102; 345/690

(58) Field of Classification Search ..... 345/100, 345/102, 690
See application file for complete search history.

(56) References Cited

U.S. PATENT DOCUMENTS 6,762,742 B2 * 7/2004 Moon et al. ..... 345/102
7,053,881 B2 * 5/2006 Itoh ..... 345/102
2004/0257318 A1 * 12/2004 Itoh ..... 345/87
2005/0001801 A1 * 1/2005 Kim ..... 345/89
2005/0140639 A1 * 6/2005 Oh et al. ..... 345/102
2005/0140640 A1 * 6/2005 Oh et al. ..... 345/102
2006/0152468 A1 * 7/2006 Ozaki ..... 345/102
2006/0279516 A1 * 12/2006 Yun ..... 345/102
2008/0129663 A1 * 6/2008 Honda ..... 345/84
2009/0167658 A1 * 7/2009 Yamane et al. ..... 345/89
2009/0243994 A1 * 10/2009 Hatano et al. ..... 345/102

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

Provided is an LCD device. The LCD device includes: an input unit, a backlight unit, a histogram analyzing unit, a data correcting unit, a liquid crystal panel driving unit, a duty ratio determining unit, and a lamp driving unit. The input unit inputs data corresponding to an image displayed on a liquid crystal panel, and the backlight unit includes a plurality of lamps. The histogram analyzing unit analyzes a histogram of data input from the input unit to generate a select signal according to a brightness state of the data. The data correcting unit corrects pixel data to be supplied to the liquid crystal panel using at least one of a plurality of gamma compensating characteristic curves. The liquid crystal panel driving unit drives the liquid crystal panel. The duty ratio determining unit generates a plurality of lamp-on signals. The lamp driving unit generates a lamp driving voltage corresponding to the lamp-on signal.

7 Claims, 5 Drawing Sheets

LIQUID CRYSTAL DISPLAY DEVICE AND DRIVING METHOD THEREOF

CROSS-REFERENCE TO RELATED APPLICATIONS

The present application claims priority under 35 U.S.C. 119 and 35 U.S.C. 365 to Korean Patent Application No. 10-2007-0070610 (filed on Jul. 13, 2007), which is hereby incorporated by reference in its entirety.

BACKGROUND

The present disclosure relates to a liquid crystal display (LCD) device, and more particularly, to an LCD device that can prevent motion blurring and improve brightness, and a driving method thereof.

The LCD device displays an image by controlling light transmittance of a liquid crystal (LC) layer using an electric field applied to the LC layer in response to a video signal. Since the LCD device is a flat display device having characteristics of a small size, a slim profile, and low power consumption, it is widely used for a portable computer such as notebook personal computers (PCs), office automation (OA) apparatuses, and audio/video apparatuses. The LCD device having the characteristics of a slim profile and low power consumption is rapidly replacing cathode ray tubes (CRTs).

Since the LCD device is driven in a hold type that uses the slow response characteristic of LCs and the maintain characteristic of the LCs, a motion blurring phenomenon that an image appears dim or a tailing phenomenon that the outline of an image is dragged while a moving image is realized. Such reduction in image quality of a moving image is difficult to completely remove even when the response time of the LCs is faster than 1 frame period of 16.7 ms.

Meanwhile, the CRT is an impulse type display device instantaneously displaying an image, not maintaining data. Accordingly, motion blurring or tailing is nearly not generated while a moving is realized in the CRT. In detail, referring to FIG. 1A, the CRT allows a phosphor body to emit light for a very short initial time of one frame period (≈0.16.7 ms) to display data, and does not allow the phosphor body to emit light for the rest of the frame period. The impulse characteristic of the CRT allows a user to clearly view a moving image displayed on the CRT.

Unlike the CRT, referring to FIG. 2, the LCD device maintains a data voltage supplied to an LC cell for one frame period. Due to this hold characteristic of the LCD device, a user feels motion blurring or tailing in a moving image. The hold characteristic of the LCD device reduces display quality of a moving image. A "scanning backlight" method is proposed to remove reduction in display quality of a moving image caused by the hold characteristics of the LCD device.

FIG. 2 is a view illustrating a related art LCD device driven in a scanning backlight method.

Referring to FIG. 2, a related art LCD device includes an LC panel 2 including a plurality of pixel regions defined by a plurality of gate lines GL1-GLn and a plurality of data lines DL1-DLm to display an image on the pixel regions, a gate driver 4 driving the plurality of gate lines GL1-GLn, a data driver 6 driving the plurality of data lines DL1-DLm, a timing controller 8 controlling the gate driver 4 and the data driver 6, a backlight unit 10 including a plurality of lamps illuminating light onto the LC panel 2, and a lamp driving unit 12 sequentially driving the plurality of lamps.

The lamp driving unit 12 sequentially lights on/off the plurality of lamps included in the backlight unit 10 using a lamp driving voltage supplied from a power generator (not shown) under control of the timing controller 8. In the case where the number of the lamps included in the backlight unit 10 illuminating light onto the LC panel 2 is sixteen, the plurality of lamps are lighted on when power is supplied from the lamp driving unit 12, and lighted off when power is not supplied from the lamp driving unit 12. The lamp driving unit 12 includes a scan signal generating part and an inverter to sequentially light on/off the plurality of lamps. The scan signal generating part receives a horizontal synchronization signal Hsync and a vertical synchronization signal Vsync from the timing controller 8 to generate a lamp on/off signal for sequentially lighting on/off the plurality of lamps, and supplies the lamp on/off signal to the inverter. The inverter supplies a lamp driving voltage to each lamp in response to the lamp on/off signal to sequentially light on/off the plurality of lamps for one frame, thereby driving the LCD device in a scanning backlight method.

The scanning backlight method lights on/off a plurality of lamps along a scanning direction. According to the scanning backlight method, an LCD device emits light for a predetermined time section of one frame period and blocks light for the rest of the one frame period as the plurality of lamps are sequentially lighted on/off along a scanning direction, thereby operating in a quasi-impulse type. Therefore, application of the scanning backlight method can improve display quality of a moving image in an LCD device.

In an LCD device driven using the scanning backlight method, the duty ratios of a plurality of lamps are set to 60% to enhance image quality of a moving image. The LCD device driven using the scanning backlight method gradually reduces the lighted-on times of the plurality of lamps to solve a limitation such as motion blurring, thereby enhancing image quality of a moving image. Since the display quality of a moving image in an LCD device is excellent at the duty ratio of 60% for the plurality of lamps, the LCD device applying the scanning backlight method generally applies a duty ratio of 60% to control the lighted on/off times of the plurality of lamps. When a duty ratio of 60% is applied to the plurality of lamps, brightness remarkably falls down compared to the backlight method always lighting on the lamps. Accordingly, when the scanning backlight method sequentially lighting on/off a plurality of lamps is applied to an LCD device to solve a limitation such as motion blurring, a limitation of brightness reduction is generated.

SUMMARY

Embodiments provide a liquid crystal display device that can prevent motion blurring and improve brightness, and a driving method thereof.

In one embodiment, a liquid crystal display device includes: an input unit inputting data corresponding to an image displayed on a liquid crystal panel; a backlight unit including a plurality of lamps illuminating light onto the liquid crystal panel; a histogram analyzing unit analyzing a histogram of data input from the input unit to generate a select signal according to a brightness state of the data; a data correcting unit correcting pixel data to be supplied to the liquid crystal panel using at least one of a plurality of gamma compensating characteristic curves according to the brightness state of the data input from the input unit; a liquid crystal panel driving unit driving the liquid crystal panel according to data corrected by the data correcting unit; a duty ratio determining unit generating a plurality of lamp-on signals having different duty ratios, respectively, according to the brightness state of the data input from the input unit; and a lamp driving unit generating a lamp driving voltage corresponding to the lamp-on signal output from the duty ratio determining unit to sequentially light on/off the plurality of lamps.

In another embodiment, a method for driving a liquid crystal display device including a liquid crystal panel and a plurality of lamps illuminating light onto the liquid crystal panel includes: inputting data corresponding to an image to be displayed on the liquid crystal panel; analyzing a histogram of the input data to generate a plurality of select signals corresponding to brightness states; generating a plurality of lamp-on signals having different duty ratios, respectively, to selectively output one of the lamp-on signals in response to the select signal; and generating a lamp driving voltage corresponding to the selectively output lamp-on signal to sequentially light on/off the plurality of lamps.

The details of one or more embodiments are set forth in the accompanying drawings and the description below. Other features will be apparent from the description and drawings, and from the claims.

DETAILED DESCRIPTION OF THE EMBODIMENTS

Any reference in this specification to "one embodiment," an embodiment, "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Reference will now be made in detail to the embodiments of the present disclosure, examples of which are illustrated in the accompanying drawings.

Figure 3:
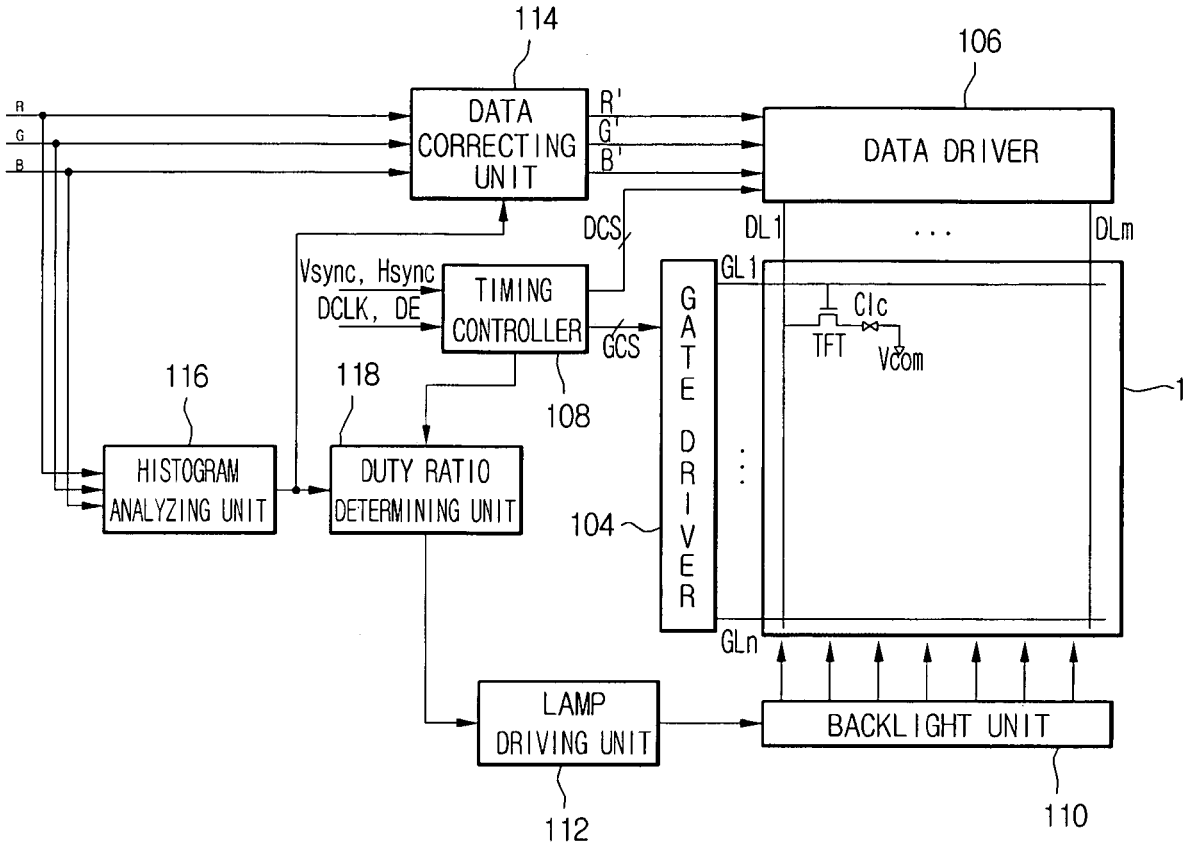
FIG. 3 is a view of an LCD device according to an embodiment.

FIG. 3 is a view of an LCD device according to an embodiment.

Referring to FIG. 3, the LCD device includes an LC panel 102 including a plurality of gate lines GL1-GLn and a plurality of data lines DL1-DLm to display an image, a gate driver 104 driving the plurality of gate lines GL1-GLn, a data driver 106 driving the plurality of data lines DL1-DLm, a timing controller 108 controlling the gate driver 104 and the data driver 106, a backlight unit 110 including a plurality of lamps illuminating light onto the LC panel 102, and a lamp driving unit 112 sequentially driving the plurality of lamps.

Also, the LCD device further includes a histogram analyzing unit 116 for analyzing a histogram for each of red (R), green (G), and blue (B) data supplied from an external system, a duty ratio determining unit 118 determining the duty ratios of the plurality of lamps according to brightness distribution analyzed by the histogram analyzing unit 116, and a data correcting unit 114 correcting R, G, and B data supplied from the external system according to the brightness distribution analyzed by the histogram analyzing unit 116.

The LC panel 102 includes pixels formed in regions, respectively, defined by the plurality of gate lines GL1-GLn and the data lines DL1-DLm. Each of the pixels includes a thin film transistor (TFT) formed in a region by crossing of a corresponding gate line GL and a corresponding data line DL, and an LC cell Clc connected between the TFT and a common electrode Vcom.

The TFT switches a pixel data voltage to be supplied to a corresponding LC cell Clc from a corresponding data line DL in response to a gate scan signal on a corresponding gate line GL. The LC cell Clc includes the common electrode and a pixel electrode connected to the TFT. The common electrode and the pixel electrode face each other with the LC layer interposed. The LC cell Clc is charged with a pixel data voltage supplied through the corresponding TFT.

Also, the voltage charging the LC cell Clc is updated whenever the corresponding TFT is turned-on.

In addition, each of the pixels on the LC panel 102 includes a storage capacitor Cst connected between the TFT and a previous gate line. The storage capacitor Cst minimizes natural reduction in the voltage charging the LC cell Clc.

The gate driver 104 sequentially supplies a plurality of gate scan signals to the plurality of gate lines GL1-GLn in response to gate control signals GCS from the timing controller 110. The plurality of gate scan signals allow the plurality of gate lines GL1-GLn to be sequentially enabled by a section of one horizontal synchronization signal.

The data driver 106 generates a plurality of pixel data voltages to supply the generated pixel data voltages to the plurality of data lines DL1-DLm on the LC panel 102, respectively, whenever one of the plurality of gate lines GL1-GLn is enabled in response to data control signals DCS from the timing controller 110. For this purpose, the data driver 106 inputs pixel data from the external system by one line amount, and converts the input pixel data of one line amount into analog pixel data voltages using a gamma voltage set.

The timing controller 108 generates the gate control signals GCS and data control signals DCS using a data clock DCLK, a horizontal synchronization signal Hsync, a vertical synchronization signal Vsync, and a data enable signal DE from an external system (not shown), for example, a graphic module of a computer system, or an image demodulation module of a television receiver system. The gate control signals GCS are supplied to the gate driver 104, and the data control signals DCS are supplied to the data driver 106.

The backlight unit 110 includes the plurality of lamps (not shown) generating light, and members coupled to the plurality of lamps. The light generated by the plurality of lamps is illuminated onto the LC panel 102 to determined light transmittance of an image displayed on the LC panel 102. The plurality of lamps are driven by lamp driving voltages supplied from the lamp driving unit 112. At this point, the plurality of lamps are driven using a scanning backlight method of sequentially lighting on/off the lamps using the lamp driving voltages supplied from the lamp driving unit 112.

The lamp driving unit 112 sequentially lights on/off the plurality of lamps included in the backlight unit 110. The lamp driving unit 112 generates lamp driving voltages lighting on/off the plurality of lamps in response to pulse wide modulation (PWM) signals from the duty ratio determining unit 118. The lamp driving unit 112 supplies the lamp driving voltages to the backlight unit 110 to allow the LCD device to operate using the scanning backlight method of sequentially lighting on/off the plurality of lamps included in the backlight unit 110.

The histogram analyzing unit 116 analyzes a histogram to judge the brightness states of R, G, and B data supplied from the external system. Also, the histogram analyzing unit 116 generates a select signal S/S corresponding to a condition set by a user using the analyzed histogram.

TABLE 1

| Brightness (average = Ya) | | |
|---|---|---|
| Brightness change exists | No brightness change | Select signal s/s |
| ○ | X | 00 |
| Yr1 > Ya | | 01 |
| Yr1 < Ya < Yr2 | | 10 |
| Yr2 < Ya | | 11 |

In table 1, Ya means an average of a brightness change for R, G, and B data of one frame input from the external system, Yr1 means a first reference brightness value, and Yr2 means a second reference brightness value.

For example, referring to Table 1, when R, G, and B data of one frame input from the external system have the same gray scale, the histogram analyzing unit 116 generates a first select signal S/S having a logical value of "00". The histogram analyzing unit 116 analyzes a histogram of R, G, and B data input from the external system to judge brightness change. When the input R, G, and B data have the same gray scale, the histogram analyzing unit 116 generates a first select signal S/S having a logical value of "00".

Also, the histogram analyzing unit 116 generates a second select signal S/S having a logical value of "01" when brightness change in R, G, and B data of one frame input from the external system exists, particularly, when the average brightness value Ya is smaller than or equal to the first reference value Yr1. Also, the histogram analyzing unit 116 generates a third select signal S/S having a logical value of "10" when brightness change in R, G, and B data of one frame input from the external system exists, particularly, when the average brightness value Ya is greater than the first reference brightness value Yr1 and smaller than the second reference brightness value Yr2. The histogram analyzing unit 116 generates a fourth select signal S/s having a logical value of "11" when brightness change in R. G, and B data of one frame input from the external system exists, particularly, when the average brightness value Ya is greater the second reference brightness value Yr2.

Though the histogram analyzing unit 116 generates the first to fourth select signals according to the embodiment, the histogram analyzing unit 116 can generate select signals having a more number of cases depending on the number of set reference brightness values.

Also, though the histogram analyzing unit 116 generates select signals using an average brightness value of input data when brightness change in data input from the external system exists according to the embodiment, the histogram analyzing unit 116 can generate select signals using a brightness value having a maximum gray scale of input data instead of the average brightness value.

Figure 1A:
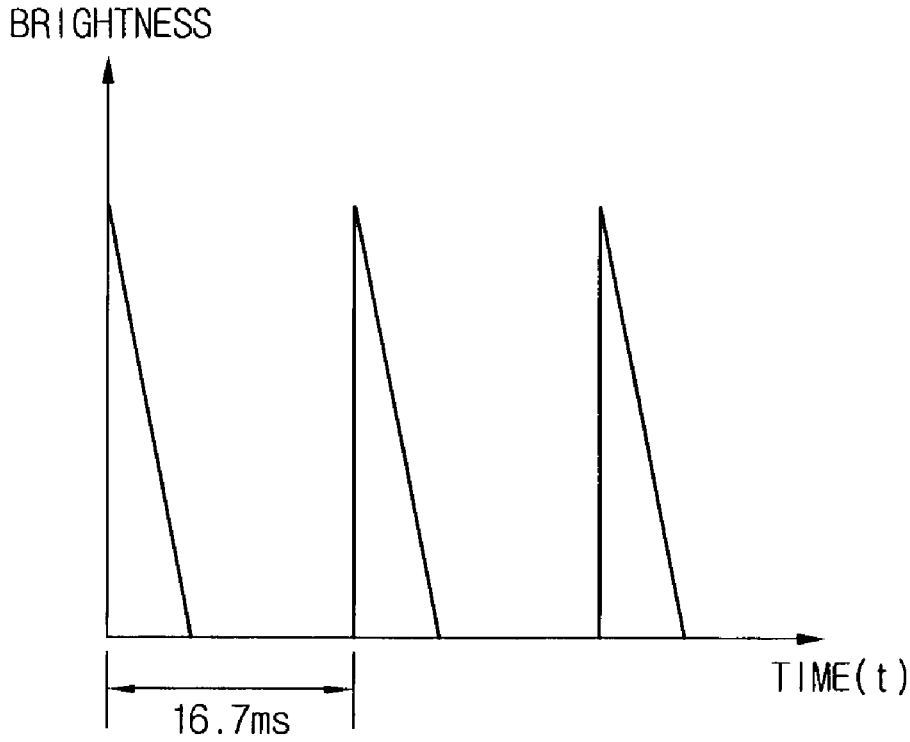
FIG. 1A is a graph illustrating the impulse characteristic of a CRT.
Figure 1B:
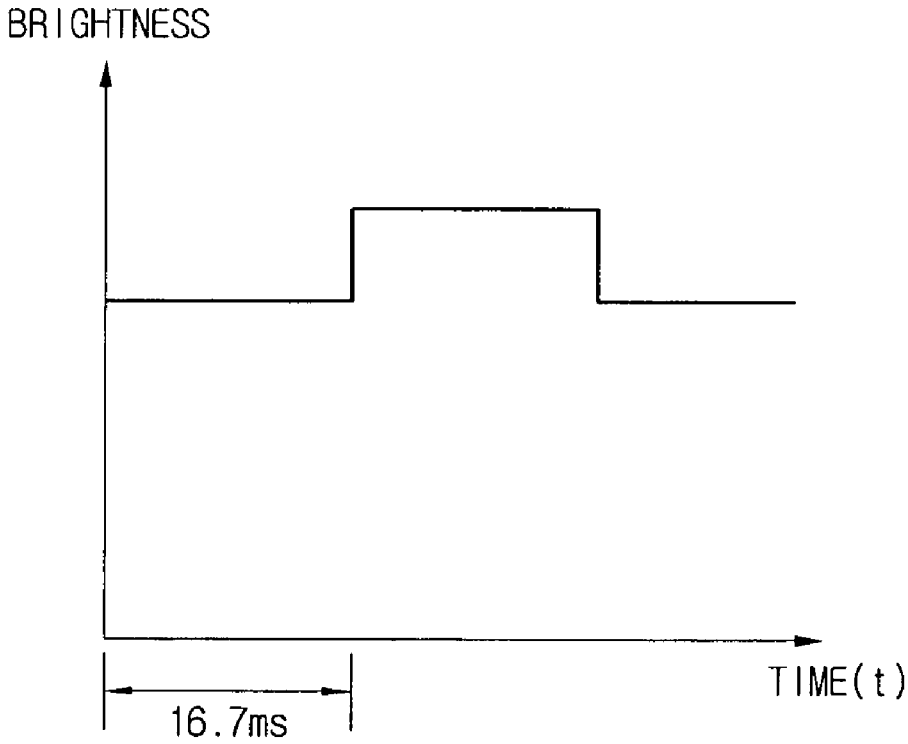
FIG. 1B is a graph illustrating a maintain characteristic of an LCD device.
Figure 2:
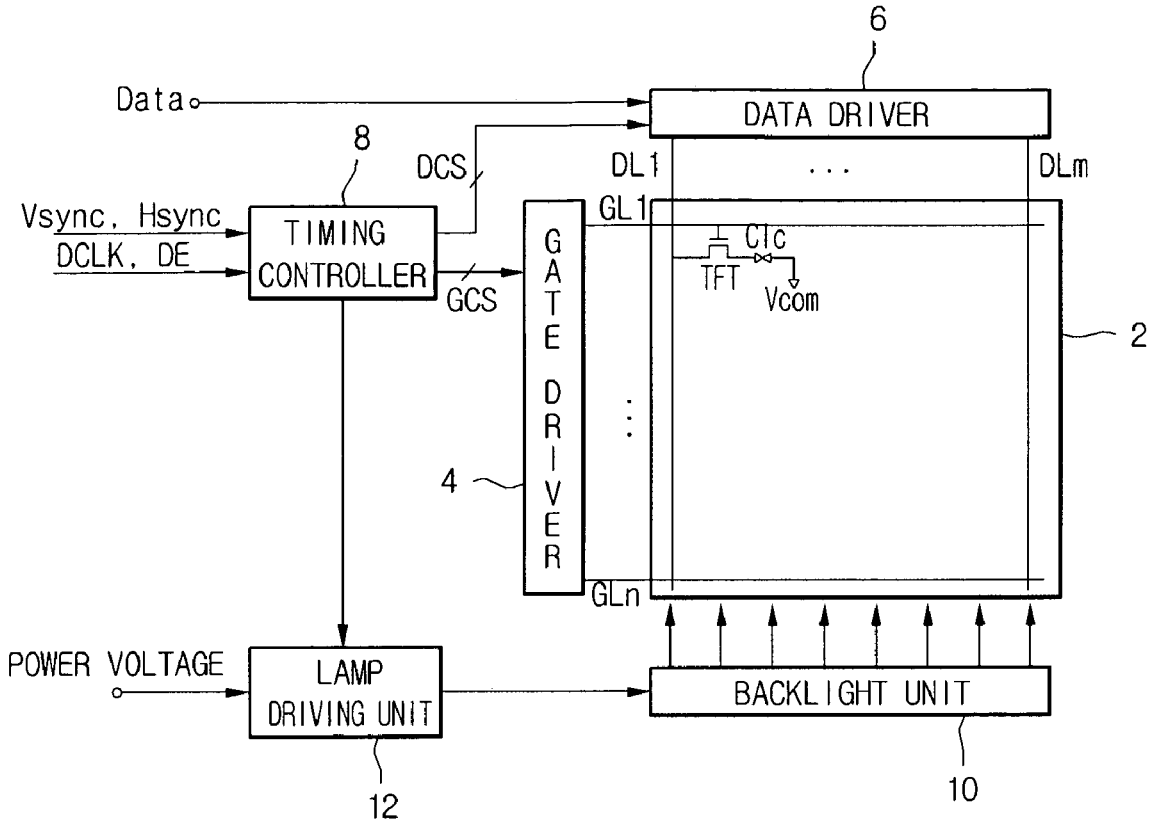
FIG. 2 is a view of a related art LCD device driven using a scanning backlight method.

The data correcting unit 114 applies different compensation ratios that depend on a gamma characteristic to R, G, and B data supplied from the external system, respectively, to generate corrected data and supplies the corrected data to the data driver 106 of FIG. 1. In detail, referring to FIG. 4, the data correcting unit 114 includes a frame delay 120 delaying R, G, and B data supplied from the external system for one frame, a compensation ratio table 122 setting a plurality of compensation ratios for compensating for a gamma characteristic to select one of the plurality of compensation ratios according to a select signal supplied from the histogram analyzing unit 116, and an adder 124 performing an operation of applying a compensation ratio selected from the compensation ratio table 122 to the R, G, and B data delayed by the frame delay 120.

The frame delay 120 delays R, G, and B data input from the external system for one frame to control timing as the histogram analyzing unit 116 analyzes the histograms of the R, G, and B data input from the external system.

The compensation ratio table 122 is a table setting a plurality of compensation ratios that can compensate for a gamma characteristic to improve brightness that depends on a gray scale. The compensation ratio table 122 sets in advance the compensation ratios that can compensate for a gamma characteristic and improve brightness reduction that depends on a gray scale of input data in the case where the LCD device is driven using the scanning backlight method to selectively output a relevant compensation ratio of the set compensation ratios according to a select signal S/S from the histogram analyzing unit 116.

Figure 5:
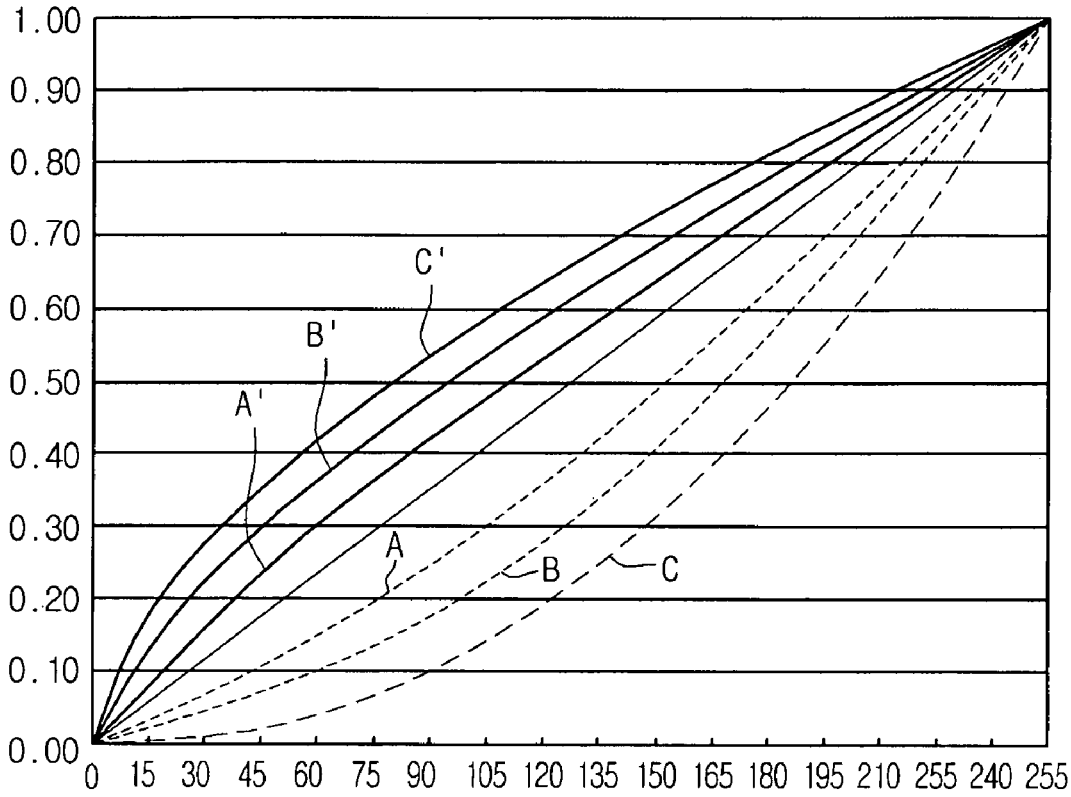
FIG. 5 is a view of a gamma compensating characteristic curve linearly compensating for a plurality of gamma characteristic curves.

Referring to FIG. 5, the compensation ratio table 122 sets a compensation ratio that compensates for a gamma curve A showing a first gamma characteristic using a first gamma compensation curve A' to provide a linear gamma characteristic. Also, the compensation ratio table 122 sets a compensation ratio that compensates for a gamma curve B showing a second gamma characteristic using a second gamma compensation curve B' to provide a linear gamma characteristic, and sets a compensation ratio that compensates for a gamma curve C showing a third gamma characteristic using a third gamma compensation curve C' to provide a linear gamma characteristic. The compensation ratio table 122 selects one of the plurality of compensation ratios according to the logical value of a select signal S/S supplied from the histogram analyzing unit 116 to supply the selected compensation ratio to the adder 124.

The adder 124 applies a compensation ratio supplied from the compensation ratio table 122 to perform an operation on data delayed for one frame by the frame delay 120, generate a compensation ratio-applied corrected data, and output the corrected data to the data driver 106 of FIG. 3. The corrected data is data to which the compensation ratio by the gamma characteristic curve has been applied, and that can improve brightness reduction caused by brightness change.

Figure 4:
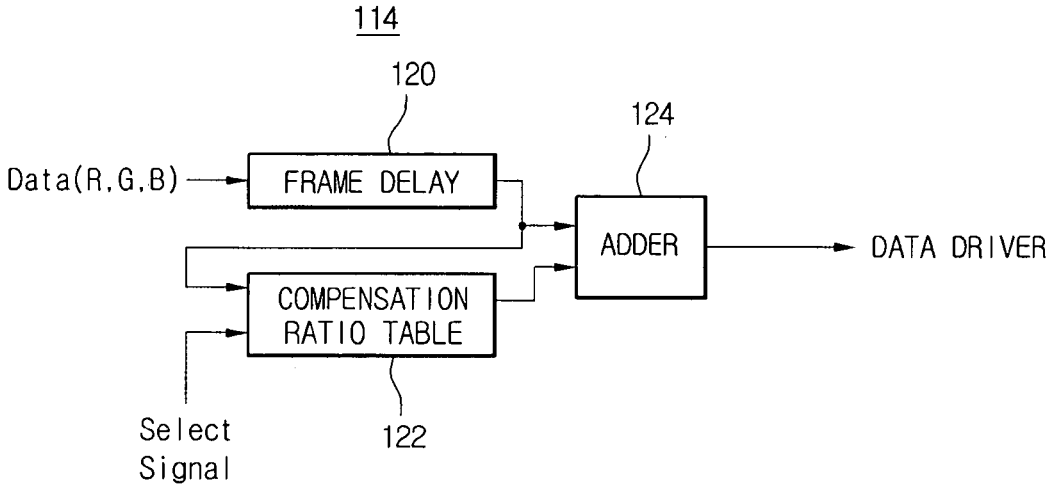
FIG. 4 is a detailed view of the data correcting unit of FIG. 3.
Figure 6:
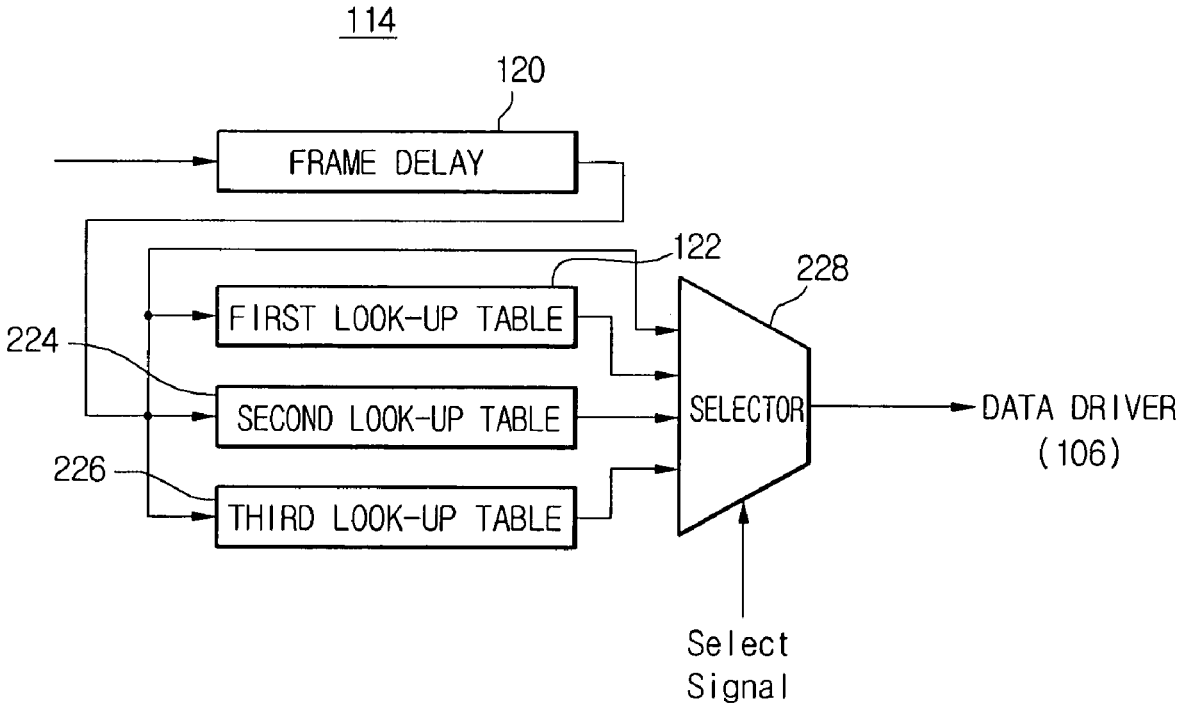
FIG. 6 is a view of the data correcting unit of FIG. 4 according to another embodiment.

FIG. 6 is a view of the data correcting unit of FIG. 4 according to another embodiment.

Referring to FIG. 6, the data correcting unit 214 includes a frame delay 120 temporarily delaying data supplied from the external system for one frame, first to third look-up tables 222, 224, and 226 having corrected data obtained by applying compensation ratios compensated for according to a gamma characteristic to the data delayed by the frame delay 120, and a selector 228 selecting one of the first to third look-up tables 222, 224, and 226 according to a select signal supplied from the histogram analyzing unit 116 of FIG. 3.

First corrected data obtained by applying a first compensation ratio that can compensate for the first gamma characteristic A of FIG. 5 and improve brightness caused by a gray scale to data stored in a frame memory are mapped to the first look-up table 222.

Second corrected data obtained by applying a second compensation ratio that can compensate for the second gamma characteristic B of FIG. 5 and improve brightness caused by a gray scale to data stored in the frame memory are mapped to the second look-up table 224.

Third corrected data obtained by applying a third compensation ratio that can compensate for the third gamma characteristic C of FIG. 5 and improve brightness caused by a gray scale to data stored in the frame memory are mapped to the third look-up table 226.

At this point, the first to third compensation ratios are different from one another. The first to third corrected data mapped to the first to third look-up tables 222, 224, and 226, respectively, are supplied to the selector 228. Also, the data delayed for one frame by the frame delay 120 are supplied to the selector 228.

The selector 228 selects one of the first to third corrected data supplied from the first to third look-up tables 222, 224, and 226, and the data supplied from the frame delay 120 according to a select signal S/S supplied from the histogram analyzing unit 116 of FIG. 3 to supply the selected data to the data driver 106.

In detail, when the first select signal S/S having a logical value of "00" is supplied from the histogram analyzing unit 116, the selector 228 selects the data supplied from the frame delay 120 to supply the selected data to the data driver 106. When the second select signal S/S having a logical value of "01" is supplied from the histogram analyzing unit 116, the selector 228 selects the first corrected data supplied from the first look-up table 222 to supply the selected data to the data driver 106. When the third select signal S/S having a logical value of "10" is supplied from the histogram analyzing unit 116, the selector 228 selects the second corrected data supplied from the second look-up table 224 to supply the selected data to the data driver 106. When the fourth select signal S/S having a logical value of "11" is supplied from the histogram analyzing unit 116, the selector 228 selects the third corrected data supplied from the third look-up table 226 to supply the selected data to the data driver 106.

The selector 228 selects the data supplied from the frame delay 120 in the case where the gray scale of the data input from the external system is the same. The selector 228 selects the first corrected data supplied from the first look-up table 222 in the case where there exists brightness change in the data input from the external system and the average brightness value of the input data is smaller than the first reference brightness value. The selector 228 selects the second corrected data supplied from the second look-up table 224 in the case where there exists brightness change in the data input from the external system and the average brightness value of the input data is greater than the first reference brightness value and smaller than the second reference brightness value. The selector 228 selects the third corrected data supplied from the third look-up table 226 in the case where there exists brightness change in the data input from the external system and the average brightness value of the input data is greater than the second reference brightness value.

As described above, the data correcting unit 214 compensates for a gamma characteristic according to a brightness change degree of the data input from the external system to generate the corrected data improving brightness.

Figure 7:
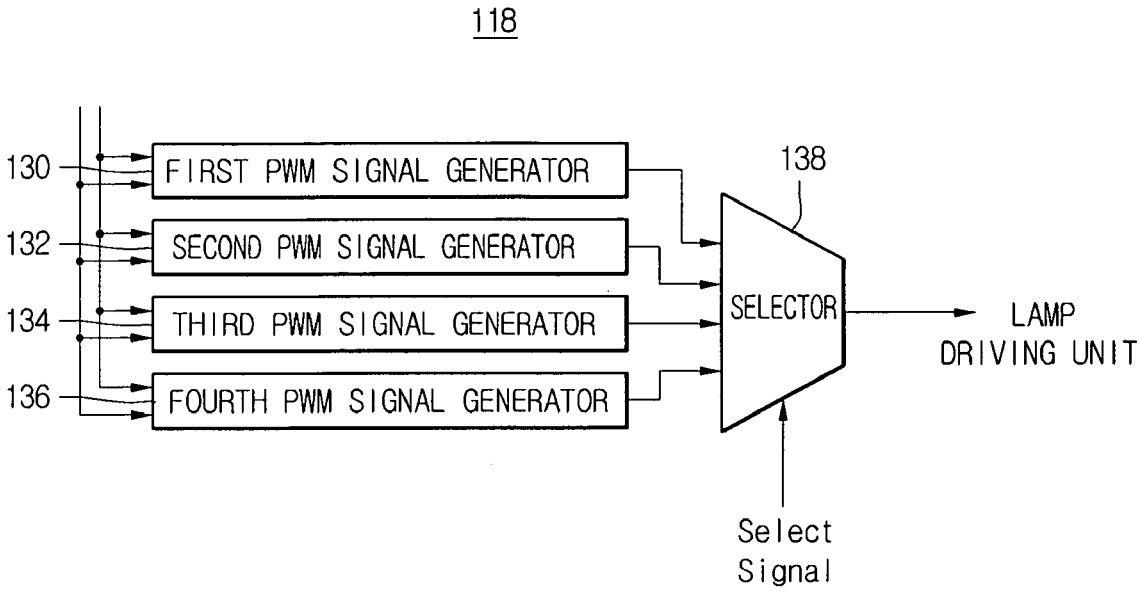
FIG. 7 is a detailed view illustrating the duty ratio determining unit of FIG. 3.

FIG. 7 is a detailed view illustrating the duty ratio determining unit of FIG. 3.

Referring to FIGS. 3 and 7, the duty ratio determining unit 118 includes first to fourth PWM signal generators 130, 132, 134, and 136 generating first to fourth PWM signals, respectively, using synchronization signals supplied from the timing controller 108 of FIG. 3, and a selector 138 selecting one of the first to fourth PWM signals generated by the first to fourth PWM signal generators 130, 132, 134, and 136 according to a select signal S/S supplied from the histogram analyzing unit 116 to supply the selected PWM signal to the lamp driving unit 112.

In detail, the first PWM signal generator 130 generates a PWM signal having a duty ratio of 100%. The PWM signal having the duty ratio of 100% generated by the first PWM signal generator 130 is a signal that can consistently light on the lamps included in the backlight unit 110. The second PWM signal generator 132 generates a PWM signal having a duty ratio of 85%. The PWM signal having the duty ratio of 85% generated by the second PWM signal generator 132 is a signal that can light on the lamps included in the backlight unit 110 for duration of 85% and light off for duration of 15%.

The third PWM signal generator 134 generates a PWM signal having a duty ratio of 70%.

The PWM signal having the duty ratio of 70% generated by the third PWM signal generator 134 is a signal that can light on the lamps included in the backlight unit 110 for duration of 70% and light off for duration of 30%. The fourth PWM signal generator 136 generates a PWM signal having a duty ratio of 60%. The PWM signal having the duty ratio of 60% generated by the fourth PWM signal generator 136 is a signal that can light on the lamps included in the backlight unit 110 for duration of 60% and light off for duration of 40%.

The first to fourth PWM signals generated by the first to fourth PWM signal generators 130, 132, 134, and 136 are supplied to the selector 138. The selector 138 selects one of the first to fourth PWM signals according to a select signal S/S supplied from the histogram analyzing unit 116 to supply the selected PWM signal to the lamp driving unit 112 of FIG. 3. The selector 138 selects a PWM signal having a predetermined duty ratio according to brightness change of input data to supply the selected PWM signal to the lamp driving unit 112.

The lamp driving unit 112 generates a lamp driving voltage corresponding to a PWM signal supplied from the selector 138. In detail, when the first PWM signal having the duty ratio of 100% is supplied from the selector 138, the lamp driving unit 112 generates a first lamp driving voltage that can consistently light on the lamps included in the backlight unit 110 of FIG. 3. When the second PWM signal having the duty ratio of 85% is supplied from the selector 138, the lamp driving unit 112 generates a second lamp driving voltage that can light on the lamps for duration of 85% and light off for duration 15%. When the third PWM signal having the duty ratio of 70% is supplied from the selector 138, the lamp driving unit 112 generates a third lamp driving voltage that can light on the lamps for duration of 70% and light off for duration 30%. When the fourth PWM signal having the duty ratio of 60% is supplied from the selector 138, the lamp driving unit 112 generates a fourth lamp driving voltage that can light on the lamps for duration of 60% and light off for duration 40%.

The first to fourth lamp driving voltages generated by the lamp driving unit 112 are supplied to the backlight unit 110 to control on/off of the lamps included in the backlight unit 110.

The above-described data correcting unit 114 compares an average brightness value of input data with a set reference value depending on whether there exists brightness change in input data, particularly, when there exists the brightness change to generate corrected data compensating for a gamma characteristic according to a select signal S/S corresponding to the comparison result. Also, the duty ratio determining unit 118 generates the plurality of PWM signals having different duty ratios, respectively, and selects one of the PWM signals according to an input select signal S/S to supply the selected PWM signal to the lamp driving unit 112.

Figure 8:
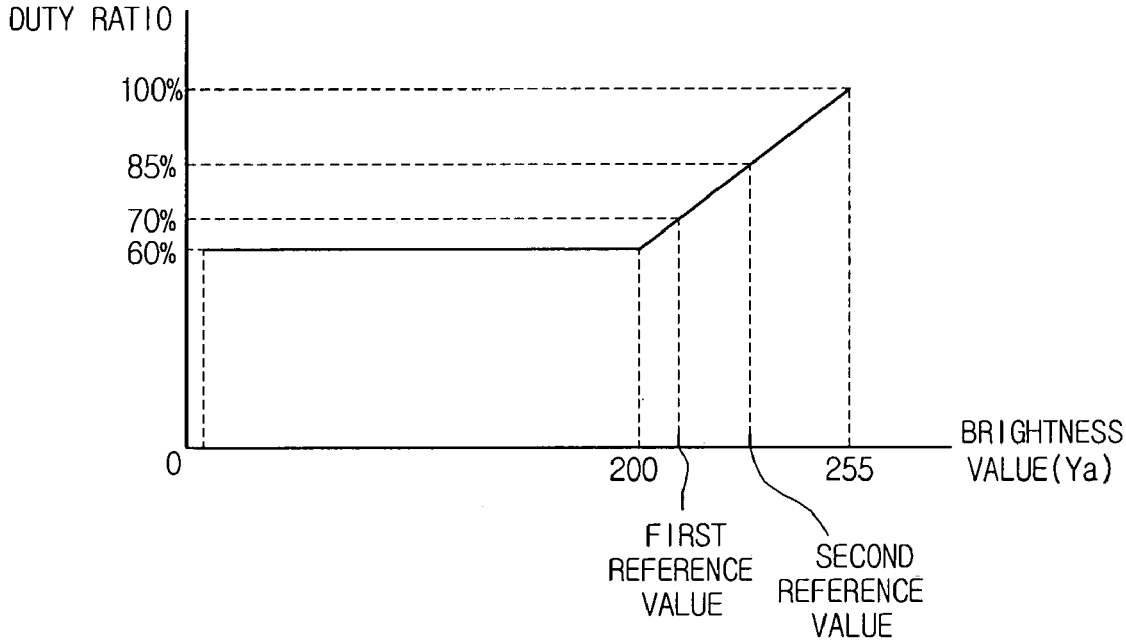
FIG. 8 is a graph illustrating relation between the average brightness of input data and a PWM signal output from the duty ratio determining unit of FIG. 7.

Relation like the curve of FIG. 8 is formed between an average brightness value of data input from the external system and PWM signals output from the duty ratio determining unit 118. When the average brightness value of the data input from the external system is less than a brightness value corresponding to a gray scale of 200 for example, the duty ratio determining unit 118 outputs a PWM signal having a duty ratio of 60%. Simultaneously, the data correcting unit 114 outputs corrected data compensating for brightness that can be reduced by the PWM signal having the duty ratio of 60%.

When an average brightness value of data input from the external system corresponds to a first reference value (reference brightness value), the duty ratio determining unit 118 outputs a PWM signal having a duty ratio of 70%. Simultaneously, the data correcting unit 114 outputs corrected data compensating for brightness that can be reduced by the PWM signal having the duty ratio of 70%. When an average brightness value of data input from the external system corresponds to a second reference value (reference brightness value), the duty ratio determining unit 118 outputs a PWM signal having a duty ratio of 85%. Simultaneously, the data correcting unit 114 outputs corrected data compensating for brightness that can be reduced by the PWM signal having the duty ratio of 85%. When an average brightness value of data input from the external system corresponds to a maximum gray scale, the duty ratio determining unit 118 outputs a PWM signal having a duty ratio of 100%.

Since brightness reduces when a duty ratio is small, when the duty ratio determining unit 118 outputs a PWM signal having a smallest duty ratio (for example, duty ratio of 60%), the data correcting unit 114 outputs corrected data that applies a largest compensation ratio to compensate for brightness. Since inverse proportion relation is established between a duty ratio of the duty ratio determining unit 118 and a compensation ratio of the data correcting unit 114, when the duty ratio determining unit 118 outputs a PWM signal having a duty ratio of 60, the data correcting unit 114 outputs corrected data obtained by applying a largest compensation ratio to data input from the external system to compensate for brightness. Also, when the duty ratio determining unit 118 outputs a PWM signal having a duty ratio of 85%, the data correcting unit 114 outputs corrected data obtained by applying a compensation ratio smaller than a compensation ratio that has been applied for a duty ratio of 60% to compensate for brightness. As described above, the corrected data output from the data correcting unit 114 is data that can improve brightness reduction caused by the duty ratio output from the duty ratio determining unit 118.

Consequently, the LCD device of the embodiment controls a duty ratio according to brightness change of input data, and simultaneously, outputs corrected data obtained by applying a different compensation ratio according to brightness change of the input data to compensate for brightness. Accordingly, the LCD device can prevent motion blurring and simultaneously improve brightness of the LC panel on the whole when the LCD device is driven using the scanning backlight method.

As described above, the LCD device of the embodiment controls a duty ratio according to brightness change of input data, and simultaneously, outputs corrected data obtained by applying a different compensation ratio according to brightness change of the input data to compensate for brightness. Accordingly, the LCD device can prevent motion blurring and simultaneously improve brightness of the LC panel on the whole when the LCD device is driven using the scanning backlight method.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device comprising:

an input unit inputting data corresponding to an image displayed on a liquid crystal panel;

a backlight unit including a plurality of lamps illuminating light onto the liquid crystal panel;

a histogram analyzing unit analyzing a histogram of input data from the input unit to generate a select signal according to a brightness state of the data;

a data correcting unit correcting pixel data to be supplied to the liquid crystal panel using at least one of a plurality of gamma compensating characteristic curves according to the brightness state of the input data from the input unit;

a liquid crystal panel driving unit driving the liquid crystal panel according to data corrected by the data correcting unit;

a duty ratio determining unit generating a plurality of lamp-on signals having different duty ratios, respectively, according to the brightness state of the input data from the input unit; and a lamp driving unit generating a lamp driving voltage corresponding to the lamp-on signal output from the duty ratio determining unit to sequentially light on/off the plurality of lamps, wherein the histogram analyzing unit analyzes a histogram of the input data from the input unit to judge whether brightness changes, and compares an average brightness value of the input data with a first reference brightness values and a second reference brightness value corresponding to a condition set by a user in advance to generate first to fourth select signals as a result of the comparison when the brightness changes, wherein the second reference brightness value is larger than the first reference brightness value, wherein the data correcting unit applies different compensation ratios that depend on the gamma characteristic curves to the input data from the input unit to generate the corrected data, wherein the duty ratio determining unit comprises first to fourth lamp-on signal generators corresponding to the first to fourth select signals, respectively, wherein the duty ratio determining unit selects one of the first to fourth lamp-on signal generators according to the select signal provided from the histogram analyzing unit, the selected lamp-on signal generator supplies a lamp-on signal to the lamp driving unit, wherein the first to fourth lamp-on signals generated by the first to fourth lamp-on signal generators have a different duty ratio, respectively.

2. The liquid crystal display device according to claim 1, wherein the data correcting unit comprises:

a plurality of look-up tables having data obtained by applying a plurality of compensation ratios compensating for brightness according to a gamma characteristic to the input data from the input unit; and a selector selecting one of the plurality of look-up tables in response to a select signal from the histogram analyzing unit, wherein the data correcting unit further comprises a frame delay for delaying the input data from the input unit for one frame to control timing as the histogram analyzing unit analyzes a histogram of the input data from the input unit.

3. The liquid crystal display device according to claim 1, wherein the data correcting unit comprises a frame delay delaying the input data from the input unit for one frame to control timing as the histogram analyzing unit analyzes a histogram of the input data from the input unit, a compensation ratio table setting a plurality of compensation ratios for compensating for a gamma characteristic to select one of the plurality of compensation ratios according to the select signal from the histogram analyzing unit, and an adder performing an operation of applying a compensation ratio selected from the plurality of look-up tables to the data delayed by the frame delay.

4. The liquid crystal display device according to claim 1, wherein the duty ratio determining unit further comprises:

a selector selecting one of the first to the fourth of lamp-on signals according to the select signal supplied from the histogram analyzing unit.

5. A method for driving a liquid crystal display device comprising a liquid crystal panel and a plurality of lamps illuminating light onto the liquid crystal panel, the method comprising:

inputting data corresponding to an image to be displayed on the liquid crystal panel;

analyzing a histogram of the input data to generate first to fourth select signals corresponding to brightness states;

correcting pixel data to be supplied to the liquid crystal panel using at least one of a plurality of gamma compensating characteristic curves according to the brightness state of the input data;

generating first to fourth lamp-on signals corresponding to the first to fourth select signals, respectively, and selecting one of the first to fourth lamp-on signals according to the select signal; and generating a lamp driving voltage corresponding to the selectively output lamp-on signal to sequentially light on/off the plurality of lamps, wherein the analyzing the histogram of the input data comprises analyzing a histogram of the input data to judge whether brightness changes, and compares an average brightness value of the input data with a first reference brightness values and a second reference brightness value corresponding to a condition set by a user in advance to generate first to fourth select signals as a result of the comparison when the brightness changes, wherein the second reference brightness value is larger than the first reference brightness value.

6. The method according to claim 5, further comprising selecting one of a plurality of look-up tables having data obtained by applying a plurality of compensation ratios compensating for brightness according to the gamma characteristic to the input data in response to a select signal from a histogram analyzing unit, and delaying the input data for one frame to control timing as the histogram analyzing unit analyzes the histogram of the input data.

7. The method according to claim 5, further delaying the input data for one frame to control timing as the histogram analyzing unit analyzes the histogram of the input data, setting a plurality of compensation ratios for compensating for a gamma characteristic to select one of the plurality of compensation ratios according to the select signal, and adding operation of applying a compensation ratio selected from the plurality of look-up tables to the data delayed by the frame delay.

* * * * *